US005380227A

United States Patent [19]

Taylor

[11] Patent Number: 5,380,227

[45] Date of Patent: Jan. 10, 1995

[54] ELECTRICAL TERMINAL

[75] Inventor: Robert W. Taylor, Surrey, Great Britain

[73] Assignee: Cliff Electronic Components Limited, Great Britain

[21] Appl. No.: 33,260

[22] Filed: Mar. 16, 1993

[30] Foreign Application Priority Data

Aug. 24, 1992 [GB] United Kingdom ..... 9217955

[51] Int. Cl.[6] ..... H01R 4/30

[52] U.S. Cl. ..... 439/727; 439/801

[58] Field of Search ..... 439/78, 709, 725, 727, 439/728, 801, 842, 869

[56] References Cited

U.S. PATENT DOCUMENTS

| | | | |
|---|---|---|---|
| 498,407 | 5/1893 | Rich | 439/727 |
| 2,094,392 | 9/1937 | Winslow, Jr. et al. | 439/727 |
| 2,164,017 | 6/1939 | Lavarack et al. | 439/727 |
| 2,921,286 | 1/1960 | Gordon | 439/727 |
| 3,052,866 | 9/1962 | Koch | 439/727 |
| 4,365,861 | 12/1982 | Gore | 439/727 |

FOREIGN PATENT DOCUMENTS

| | | | |
|---|---|---|---|
| 0314862 | 4/1930 | United Kingdom | 439/727 |

*Primary Examiner*—Khiem Nguyen

[57] ABSTRACT

An electrical terminal 10 has two electrical connectors 16 and 18 carried by upper 12 and lower 14 insulating body members by which it is clamped to a mounting 84. Each connector has a terminal hole 64 and carries an insulating knob 66, 68, which is screw adjustable over an upper length 52 of the connector to open and close the terminal hole 64 while providing an insulating cover for the upper length of each connector. The body member 12 extends over the connectors 16 and 18 to encompass the terminal holes 64 and has access holes 38 and 40 which coincide with the respective terminal holes 64. The upper body member 12 has cavities 20 and 22 within which the insulating knobs 66 and 68 are accommodated respectively as they are adjusted longitudinally on their respective connectors. The structure and dimensions of the terminal 10 preferably ensure that the connectors in the body 12 and knobs are inaccessible to a test finger when the terminal is mounted on a housing.

17 Claims, 3 Drawing Sheets

ELECTRICAL TERMINAL

TECHNICAL FIELD & BACKGROUND ART

The present invention relates to an electrical terminal of the type comprising two insulating body members carrying an elongate electrical connector and between which body members is to be disposed a mounting to which the body members may be clamped. More particularly the invention relates to a terminal in which the connector has a transversely extending terminal hole, for receiving a wire to be attached to the terminal and which hole may be opened and closed by adjusting an insulating knob longitudinally along the length of the connector.

Such terminals are well known and are widely used in electrical audio systems for the connection, by unqualified persons, of speaker wires to power amplifiers by inserting a wire into the terminal hole of the connector and adjusting the insulating knob to close the hole and clamp the wire in contact with the connector.

While such known connectors enable the connection of wires thereto they also present possible safety hazards as when the knob is adjusted to open the terminal hole the connector (which may be a "live" terminal) is exposed to an extent that a finger may be able to touch the connector. It is an object of this invention to provide a terminal of the kind disclosed which lends itself to relatively inexpensive and simple manufacture and may have dimensional and structural characteristics which satisfy the requirements of British Standard 3042:1971 and International Standard IEC 335-1 (which concern checking the inaccessibility of live parts of electrical components with a standard test finger so that such parts in the terminal may be regarded as "touch-proof").

STATEMENT OF INVENTION & ADVANTAGES

According to the present invention there is provided an electrical terminal comprising an elongate electrical connector carried by upper and lower insulating body members between which is to be disposed a mounting for the body members to be clamped thereto to hold the terminal in position, the connector having a transversely extending terminal hole and carrying an insulating knob mounted on and longitudinally adjustable over one end part length thereof for opening and closing the terminal hole whilst providing an insulating cover for said end part length, and in which the upper body member extends longitudinally over the connector to encompass the terminal hole and has a transversely extending access hole formed therein which coincides with and provides access to the terminal hole, the upper body member having a longitudinally extending cavity within which the insulating knob is accommodated as it is adjusted longitudinally on the connector.

In the preferred form of the invention the connector has an external screw thread on said one end part length with which engages an internal screw thread on the knob for the knob to be rotatably adjusted along the length of the connector.

Locating means may be provided which co-operate between the upper body member and the connector for determining the rotational orientation of the connector in the upper body member in locating the terminal hole to coincide with the access hole. Preferably, the locating means comprise a recess in the connector which cooperates with a projection on the upper body member in the cavity thereof.

The locating means may also, or alternatively, comprise a projection on the connector which cooperates with a recess formed in the upper body member.

The connector may be received within a seating in the upper body member, which reception determines the relative longitudinal positioning of the connector in the upper member for the terminal hole and access hole to coincide. Preferably, the connector has a shoulder which is accommodated in said seating so that an opposite end part length of the connector projects through a longitudinally extending passage in the upper body member to engage with the lower body member.

The terminal may further comprise restraining means which restrain longitudinal adjustment of the knob over said one end part length of the connector between a first end position, in which the terminal hole is at least partly obturated by the knob within the cavity, and a second end position, in which the terminal hole is at least partly open to communicate with the access hole, and in both said first and second end positions the knob encloses and insulates the said one end part length of the connector. Preferably this restraining means comprises an external flange on the one end part length of the connector which cooperates with the knob to provide said restraint of the knob in the second end position. The restraining means may also, or alternatively, comprise an abutment face on the knob which abuts the upper body member to provide said restraint in the first end position.

In a preferred form of the invention the knob comprises a cylindrical skirt part extending longitudinally from a body part, said skirt part having a smaller diameter than the body part, and being received within a substantially complimentary cavity of the upper body member. The shoulder presented between the skirt part and body part may provide the aforementioned abutment face.

In a preferred form, the knob is tubular to provide a longitudinally extending port with which a longitudinally extending socket in the one end part length of the connector communicates, and through which port a spigot terminal can be inserted into the connector socket.

Preferably, the opposite end part length of the connector projects through both the upper and lower body members and comprises means longitudinally adjustable thereon for effecting clamping and securing of the terminal to the mounting. The means for effecting clamping and securing of the terminal to the mounting preferably comprises a nut rotatably adjustable along the length of an external screw thread on said opposite end part length of the connector.

In further embodiments of the present invention the upper and lower body members may carry, in spaced array, at least two said connectors and respectively associated knobs.

DRAWINGS

One embodiment of an electrical terminal constructed in accordance with the present invention will now be described, by way of example only, with reference to the accompanying illustrative drawings, in which.

DETAILED DESCRIPTION OF DRAWINGS

The electrical terminal 10 has an upper insulating body member 12 and a lower insulating body member 14 carrying two identical elongate electrical connectors 16 and 18.

Figure 2:
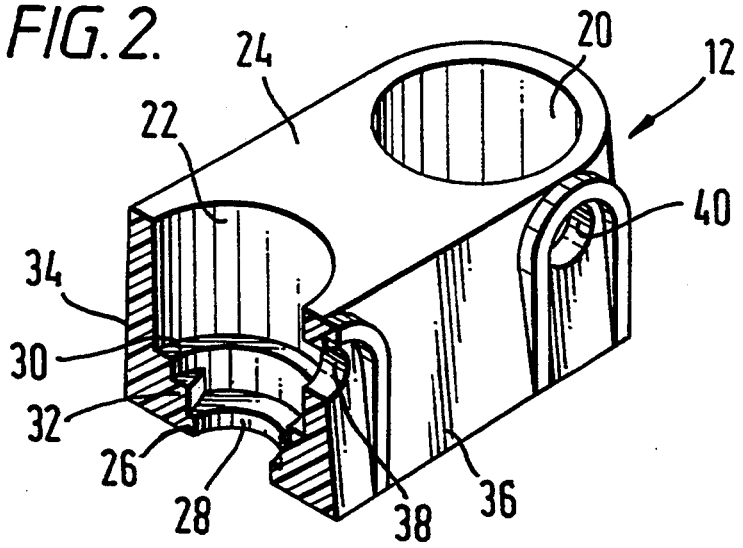
FIG. 2 is a perspective view of part of an upper body member of the terminal showing a section along the line II—II of FIG. 1.

The upper body member 12 comprises a one piece plastics moulded body having two identical and adjacent generally cylindrical cavities 20 and 22 (FIG. 2) extending longitudinally into the body from a top surface 24 thereof. A bottom surface 26 of the upper body member 12 extends across lower ends of each of the cavities 20 and 22, and through which longitudinally extends, from each cavity, a passage 28 of circular cross section having a diameter less than that of the cavity and whose central axis coincides with the longitudinal axis of the cavity, of which only the passage 28 coinciding with the cavity 22 is shown in FIG. 2. At the lower end of each cavity the diameter is reduced to form a step 30, and a projection 32 extends radially inwardly from the step 30 substantially from the region of the cavity adjacent a rear wall 34 of the body member 12.

Two access holes 38 and 40 extend transversely through a front wall 36 of the body member 12 to communicate between the exterior of the body member 12 and the cavities 22 and 20 respectively. These access holes 38 and 40 open into the corresponding cavities at a position directly opposite the projections 32 and longitudinally disposed at a position between the step 30 and the body top surface 24.

The lower body member 14 also comprises a one piece plastics moulding which will usually have a longitudinal extent (thickness) substantially less than that of the upper body member 12. The body member 14 comprises two generally cylindrical recesses 38 and 40 extending longitudinally from the lower face 42 thereof and which recesses 38 and 40 are spaced laterally so that their longitudinal axes coincide with the longitudinal axes of the two cavities 20 and 22 of the upper body member. Both recesses 38 and 40 have an upper face 44 of the lower body section 14 through which respective coaxial passages 46 and 48 extend longitudinally. Each recess 38 and 40 has a radially inwardly extending projection 50.

Figure 3:
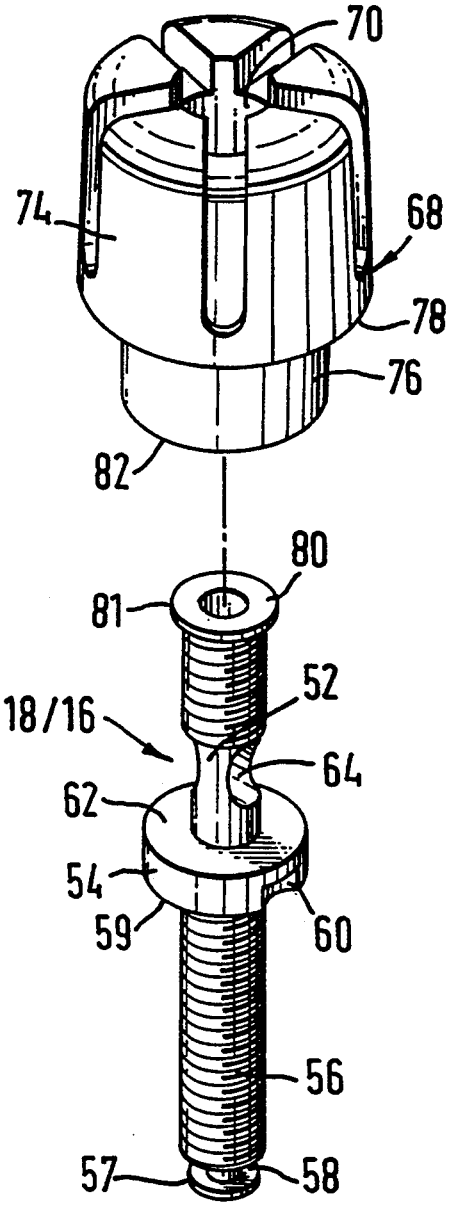
FIG. 3 is a perspective view of a connector and an insulating knob to be mounted on the connector.
Figure 4:
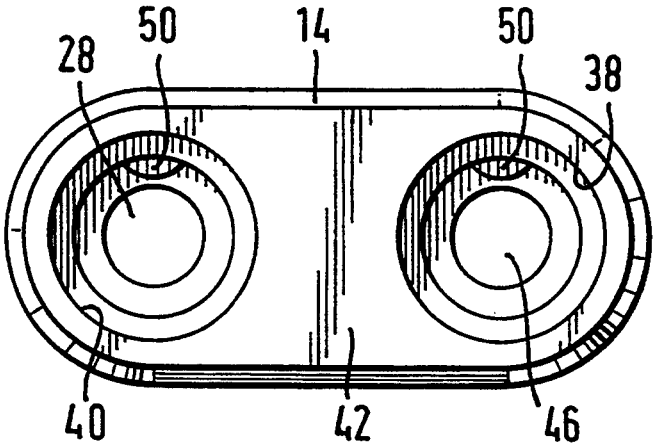
FIG. 4 is a plan view of a lower body member of the terminal.
Figure 5:
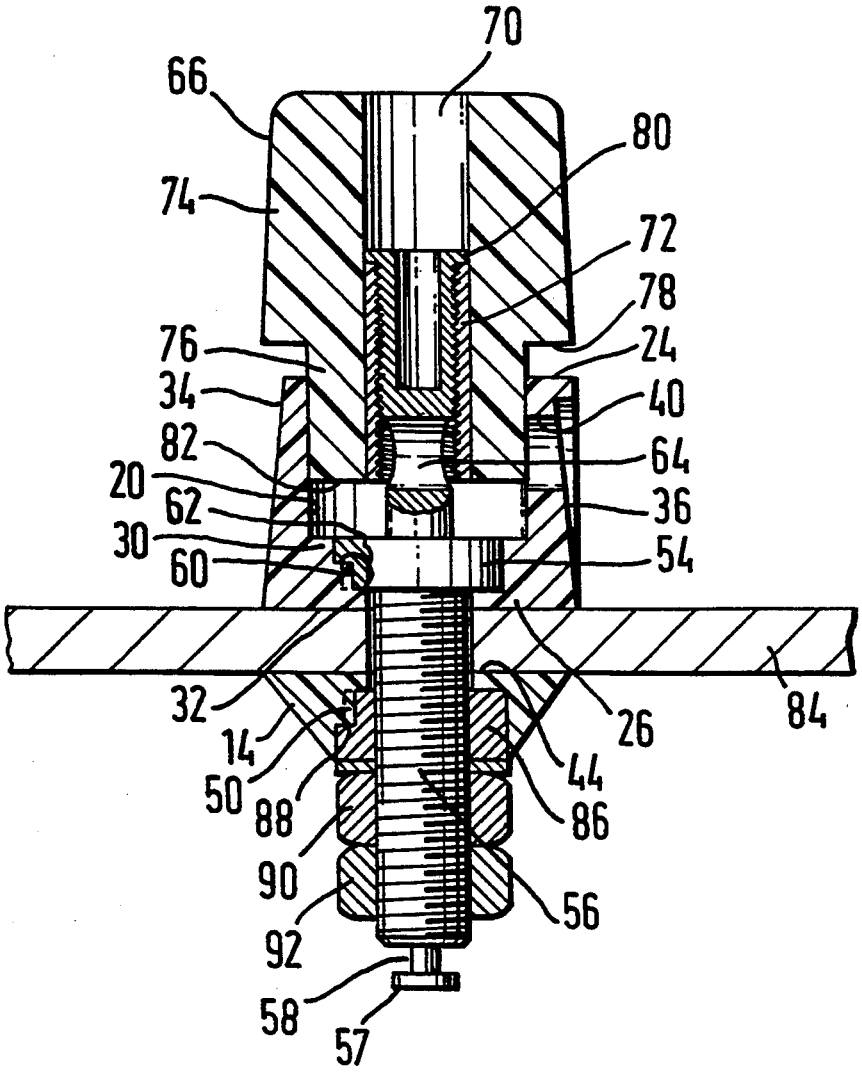
FIG. 5 is a section of the terminal along the line IV—IV of FIG. 1 showing the terminal clamped to a mounting.

The connectors 16 and 18 are identical and each comprises an elongate conducting rod, usually metallic, having three sections—an upper part length 52, a central part length portion 54 and a lower part length 56 (FIG. 3). The rod has a circular cross section with each of the three sections 52, 54 and 56 being of different diameter. The lower length 56 has the smallest diameter of the connecter sections and is externally screw threaded with a free end 57 having a circumferential recess 58 which in use may have an electrical lead attached thereto. The lower length 56 extends from a lower face 59 of the central portion 54, which latter portion has a greater diameter than the lower length 56 so that the lower face presents a shoulder. This central portion 54 has formed therein a recess 60 extending longitudinally part way along the length of the central portion from the shoulder 59. Extending from an upper flat face 62 of the central portion 54 is the upper length 52, having a diameter less than that of the central portion 54 but greater than that of the lower length 56. Formed in the upper length 52 is a transversely extending terminal hole 64 which aligns diametrically with the recess 60. The free end part of the upper length 52 is tubular and externally screw threaded.

Mounted on the upper lengths 52 of the connectors 16 and 18 are identical insulating knobs 66 and 68 respectively. These knobs are generally cylindrical and each has a longitudinally extending bore 70 extending co-axially therethrough. Mounted in each bore 70 is a metallic tube 72 having an internal screw thread which is received on the screw thread of the upper length 52 of the respective connector, allowing the knobs to be rotatably adjusted along the upper lengths 52 of the connectors until they abut with the respective central portions 54.

Each knob 66 and 68 comprises a one piece plastics moulded body having a main cylindrical body part 74 from which extends longitudinally a cylindrical skirt part 76 of diameter less than that of the main body part 74, so that a shoulder 78 is presented between the two parts.

To restrain the knobs 66 and 68 on the connectors 16 and 18 respectively, an upper end stop position is defined by an external flange 80 formed on each of the ends 81 of the upper lengths 52 of the connectors. The flanges 80 are of greater diameter than the inner diameter of the tubes 72 but of smaller diameter than the bore 70, so that as the knobs are rotatably adjusted along their respective connectors the upper end of the tubes 72 can abut against the flanges 80 when the knob is in an upper end position to prevent further longitudinal adjustment in that direction. In the upper end position the knob clears and exposes the terminal hole of its respective connector.

As each knob 66 and 68 is rotatably adjusted along the length of the connector it encompasses the free end part length of the upper length 52 of its connector and, at a certain longitudinal position on the connector, the skirt part 76 fully closes the terminal hole 64.

The connectors 16 and 18 are received longitudinally within the cavities 20 and 22 respectively of the upper body member 12 so that the lower lengths 56 extend through the passages 28 of the respective cavities and the middle portions 54 are received as a substantially complementary fit within the narrow end sections of the cavities formed by the steps 30. In this latter condition the shoulders 59 of the middle portions 54 abut the bottom surface 26 of the upper body section. The orientation of each connector within the cavity is determined by the recess 60 of the connector co-operating with the projection 32 of the cavity as these must be aligned longitudinally for the recess 60 to slidably engage the projection 32 and the connector to be fully inserted in the upper body member. The dimensions of the connectors are determined so that when they are fully inserted in the upper body member 12 the terminal holes 64 coincide transversely with the respective access holes 38 and 40 of the cavities while the co-operation between the recesses 60 and projections 32 ensure that the connectors are orientated with their terminal holes in alignment with the respective access holes. The upper body member 12 fully encompasses the terminal holes 64 of the connectors 16 and 18 when the said connectors are fully inserted and correctly orientated within the cavities 20 and 22 respectively.

Figure 1:
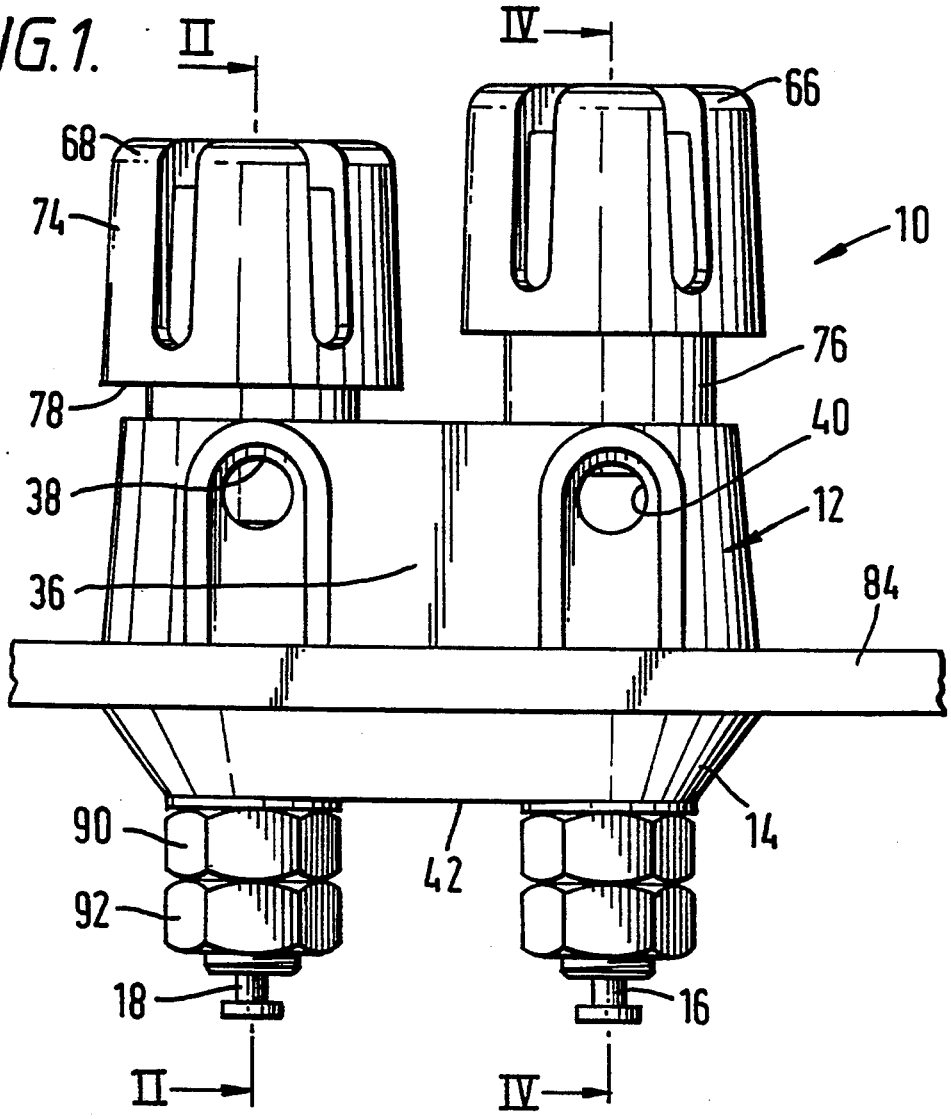
FIG. 1 is a front elevation of the electrical terminal.

Further, when the connectors 16 and 18 are fully inserted in the upper body member 12 the skirt parts 76 of the two knobs are received within the cavities, 20 and 22 respectively, as a close sliding fit. When the knobs are in their upper end positions, as previously discussed, the lower end 82 of each skirt part remains within its associated cavity but at a longitudinal position so that the terminal hole 76 of its connector is exposed from below the knob. As each knob is adjusted along the length of its connector, towards a lower end position, the skirt part 76 moves along the connector further into the cavity until the shoulder 78 abuts with the upper surface 24 of the upper body member 12 at the lower end position of the knob. At this lower end position the skirt part 76 of each knob fully encloses the terminal hole of its associated connector. FIG. 1 shows knob 66 in its upper end position and knob 68 in its lower end position.

The lower lengths 56 of the connectors 16 and 18 extends through a body mounting 84 to be received through the respective passages 46 and 48 within the lower body member 14. A washer ring 86 is mounted on the lower length 56 of each connector and received within the respective recesses 38 and 40 of the lower body member 14. Each washer ring.86 has a recess 88 which cooperates with the projection 50 of the lower body member 14 in the respective recesses to restrain that ring from rotating relative to the lower body member. Two nuts 90 and 92 are then tightened about the screw thread of the lower length of each of the connectors to drive the body members 12 and 14 longitudinally towards each other and clamp the mounting 84 therebetween. The mounting will usually be a housing of an electrical unit, with the upper body member 12 mounted on the external surface of that housing while the lower body member 14 is mounted on the interior of the housing.

In use the knobs 66 and 68 are unscrewed sufficiently to expose the terminal holes 64 and allow a wire to be inserted through the access holes 38 and 40 and into the terminal holes 64 of the connectors 16 and 18 respectively. When the knobs 66 and 68 are screwed along the connectors the terminal holes 64 are closed and a high clamping pressure may be exerted on the wire to restrain it from being withdrawn. Alternatively a spigot plug, with a wire attached thereto, may be inserted through the access holes into the terminal holes when the knob is in the upper end position. A further connection may then be made to the connectors by soldering, or otherwise attaching, a wire to the circumferential recesses 58 on the lower length 56 of the connectors within the mounting, or by inserting a spigot plug of appropriate dimensions into the port presented by the bore 70 in the top of the knobs to engage within the tubular part of the upper length 52 of the connectors. The dimensions of the access holes 38 and 40 and the knob bore 70 are preferably sized to permit the passage of 4 mm spigot plugs while being sufficiently restricted to prevent insertion of a finger (or test finger) to contact the connector.

The two knobs 66 and 68 are colour coded, one red and one black, to help distinguish a positive and negative connector in use.

Having a mind that the terminal may be utilized for providing high wattage electrical connection (which may be, say, 30 amps at 110 volts), it is desirable that parts of the conductive connectors mounted outside the mounting or casing are inaccessible to contact by a standard test finger which meets the requirements of British Standard 3042:1971 and International Standard IEC 335-1 and the arrangement of the knob and the upper body member are preferably determined to meet these safety requirements so that the connector is effectively "touchproof" when attached to a mounting, since the skirt part 76 of the knobs are restrained within the upper body member 12 when the knobs are in either their upper or lower end positions, and the knobs and upper body member encompass the upper and central part lengths of the connectors at all times.

Although this terminal is designed for particular use in the manufacture of amplifiers it may be used for any application where it is desirable to provide touchproof electrical connections. Further embodiments of this invention would include a variation in the number and spaced array of connectors.

I claim:

1. An electrical terminal comprising an elongate electrical connector carried by upper and lower insulating body members between which is to be disposed a mounting for the body members to be clamped thereto to hold the terminal in position, the connector having a transversely extending terminal hole and carrying an insulating knob mounted on and longitudinally adjustable over one end part length thereof for opening and closing the terminal hole and clamping a wire inserted therein whilst providing an insulating cover for said end part length, and in which the upper body member extends longitudinally over the connector to encompass the terminal hole and has a transversely extending access hole formed therein which coincides with and provides access to the terminal hole, the upper body member having a longitudinally extending cavity within which the insulating knob is accommodated as it is adjusted longitudinally on the connector, and retaining means are provided to define an extreme range of longitudinal displacement of the knob on the connector outwardly of the cavity to restrain the knob from displacement out of its accommodation in the cavity.

2. A terminal as claimed in claim 1 in which the connector has an external screw thread on said one end part length with which engages an internal screw thread on the knob for the knob to be rotatably adjusted along the length of the connector.

3. A terminal as claimed in claim 1 in which locating means is provided which co-operate between the upper body member and the connector for determining a rotational orientation of the connector in the upper body member whereby the terminal hole extending transversely through the connector is located to coincide with the access hole.

4. A terminal as claimed in claim 3 in which the locating means comprises a recess in the connector which cooperates with a projection on the upper body member in the cavity thereof.

5. A terminal as claimed in claim 3 in which the locating means comprises a projection on the connector which cooperates with a recess formed in the upper body member.

6. A terminal as claimed in claim 1 in which the connector is received within a seating in the upper body member, which reception determines a longitudinal positioning of the connector in the upper body member whereby the terminal hole and access hole coincide.

7. A terminal as claimed in claim 6 in which the connector has a shoulder which is accommodated in said seating so that an opposite end part length of the connector projects through a longitudinally extending passage in the upper body member to engage with the lower body member.

8. A terminal as claimed in claim 1 and comprising restraining means which restrain longitudinal adjustment of the knob over said one end part length of the connector between a first end position, in which the terminal hole is at least partly obturated by the knob within the cavity, and a second end position, in which the terminal hole is at least partly open to communicate with the access hole, and in both said first and second end positions the knob encloses and insulates the said one end part length of the connector.

9. A terminal as claimed in claim 8 in which the restraining means comprises an external flange on the one end part length of the connector which cooperates with the knob to provide said restraint of the knob in the second end position.

10. A terminal as claimed in claim 8 in which the restraining means comprises an abutment face on the knob which abuts the upper body member to provide said restraint in the first end position.

11. A terminal as claimed in claim 1 in which the knob comprises a cylindrical skirt part extending longitudinally from a body part, said skirt part having a smaller diameter than the body part and being received within a substantially complimentary cavity of the upper body member.

12. A terminal as claimed in claim 10 in which the knob comprises a cylindrical skirt part extending longitudinally from a body part, said skirt part having a smaller diameter than the body part and being received within a substantially complementary cavity of the upper body member and wherein a shoulder presented between the skirt part and body part provides said abutment face.

13. A terminal as claimed in claim 1 in which the knob is tubular to provide a longitudinally extending port with which a longitudinally extending socket in the one end part length of the connector communicates, and through which port a spigot terminal can be inserted into the connector socket.

14. A terminal as claimed in claim 1 in which an opposite end part length of the connector projects through both the upper and lower body members and comprises means longitudinally adjustable thereon for effecting clamping and securing of the terminal to the mounting.

15. A terminal as claimed in claim 14 in which means for effecting clamping and securing of the terminal to the mounting comprises a nut rotatably adjustable along the length of an external screw thread on said opposite end part length of the connector.

16. A terminal as claimed in claim 1 in which the upper and lower body members carry, in spaced array, at least two said connectors and respectively associated said knobs.

17. A terminal as claimed in claim 1 in which the retaining means comprises a flange located on the connector against which the knob abuts when at it extreme range of longitudinal displacement outwardly of the cavity.

* * * * *